US005988133A

United States Patent [19]

Agapiades et al.

[11] Patent Number: 5,988,133

[45] Date of Patent: Nov. 23, 1999

[54] ENGINE DISC VALVE

[76] Inventors: Thomas Agapiades; Fotis Agapiades, both of 1269 Stafford Way, Yuba City, Calif. 95991

[21] Appl. No.: 09/030,528

[22] Filed: Feb. 24, 1998

[51] Int. Cl.[6] ..... F01L 7/00

[52] U.S. Cl. ..... 123/190.14; 123/80 D

[58] Field of Search ..... 123/190.14, 80 D

[56] References Cited

U.S. PATENT DOCUMENTS

| | | | |
|---|---|---|---|
| 670,060 | 3/1901 | Quick | 123/151 |
| 1,098,679 | 6/1914 | Mueller et al. | 123/59.4 |
| 1,222,681 | 4/1917 | Schofield | 184/6.8 |
| 1,227,698 | 5/1917 | Tibbetts | 123/41.76 |
| 1,282,602 | 10/1918 | Lindstrom | 123/190.14 |
| 2,444,696 | 7/1948 | De la Riestra et al. | 123/190.14 |
| 4,418,658 | 12/1983 | Di Ross | 123/80 D |
| 5,558,049 | 9/1996 | Dubose | 123/80 DD |

*Primary Examiner*—Noah P. Kamen
*Assistant Examiner*—Hai Huynh

[57] ABSTRACT

Within the cylinder head of an internal combustion engine, a rotatively mounted disc valve having beveled gear teeth upon the edge of its outer perimeter and a plurality of equally spaced ports about its center of rotation for cyclic indexing with a like number of sets of exhaust and intake conduits within the said cylinder head leading from the combustion chamber to respective exhaust and intake manifolding. The disc valve completes one whole revolution for every eight revolutions of the crankshaft of said internal combustion engines.

1 Claim, 3 Drawing Sheets

ENGINE DISC VALVE

CROSS REFERENCES

The present invention provides new and useful improvements to the basic engine valve design of copending application Ser. No. 08/808,460 filed Mar. 3, 1997.

SUMMARY OF THE INVENTION

The invention is a disc valve which is rotatively mounted in the engine cylinder head. Rotation of the disc periodically opens and closes a plurality of exhaust and intake ports in the corresponding sequential alternating order of the engine thermodynamic cycle. The manifolding circuits of the disc valve provide the necessary regenerative heating required to complete the preignition mechanical vaporization and mixing processes required for the maximum efficiency of combustion. In this respect the intake system is uniquely beneficial to the efficient combustion of alcohol fuels which have comparatively high boiling points and high spontaneous ignition temperatures.

The engine disc valve is made cost effective in its manner of manufacture as a sintered copper alloy compaction. Manufacture in this manner provides bronze oilite bearing surfaces on both sides of the disc reducing friction and lubrication requirements. Friction is further reduced by slowing the disc rotational speed. The disc is geared such that it rotates only once for every eight rotations of the engine crankshaft.

It is the primary objective of the invention to provide a method of efficient fuel combustion by providing a means of completing the precombustion mechanical processes outside of the combustion chamber.

It is another object of the invention to provide a plurality of inlets to the combustion chamber to assure the even distribution of the air/fuel mixture into the engine cylinder during the intake stroke.

It is yet another object of the invention to provide a cost efficient method of manufacture of engine valves.

Still further it is an object of the design to provide wear efficient surfaces of the disc valve such that it reduces the amount of lubrication required.

BRIEF DESCRIPTION OF THE DRAWINGS

There are drawings presented as part of the specification showing the details of the disc valve and its placement in the engine.

DETAILED DESCRIPTION

Figure 1:
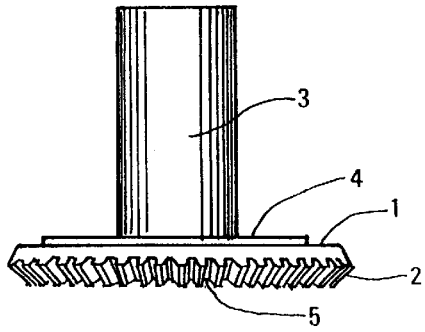
FIG. 1 Is a frontal view of the disc valve.

FIG. 1 is a side-view of the engine disc valve hereinafter referred to as disc 1. In high production disk 1 is manufactured as a sintered powder copper alloy compaction formed to its near net working dimensions. Features comprising disc 1 are bevel gear teeth 2 used as a means of inducing the rotational movement of disc 1 about the axial center of shaft 3. Shaft 3 is rotatively mounted in the engine cylinder head and top sealing surfaces 4 are in slidable contact with the said engine cylinder head.

Figure 2:
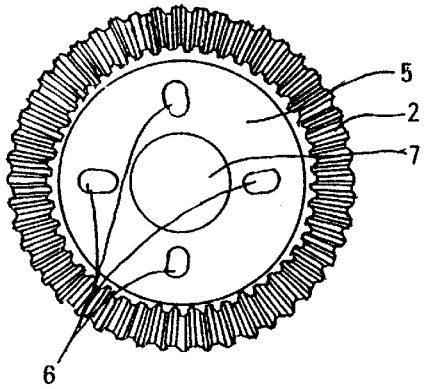
FIG. 2 Shows the bottom surfaces of the disc valve.

Turning now to FIG. 2 which shows the underside features of disc 1 comprising the bottom sealing surfaces 5, sequencing ports 6 equally spaced about the axial center of rotation, spark plug hole 7 formed as the bored center of shaft 3.

Figure 3:
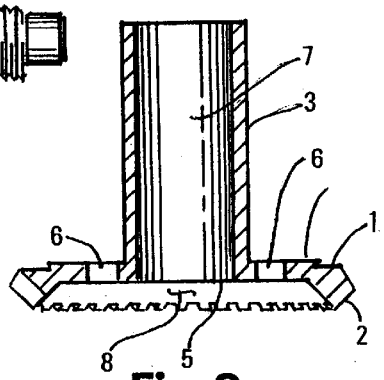
FIG. 3 Is a section taken through the axial center of the disc valve passing through two opposite valve ports.

FIG. 3 is a section taken through the center of disc 1 passing through ports 6. The bevel gear teeth 2 are recessed on the underside of disc 1 forming recess 8 comprising the bottom sealing surface 5.

Figure 4:
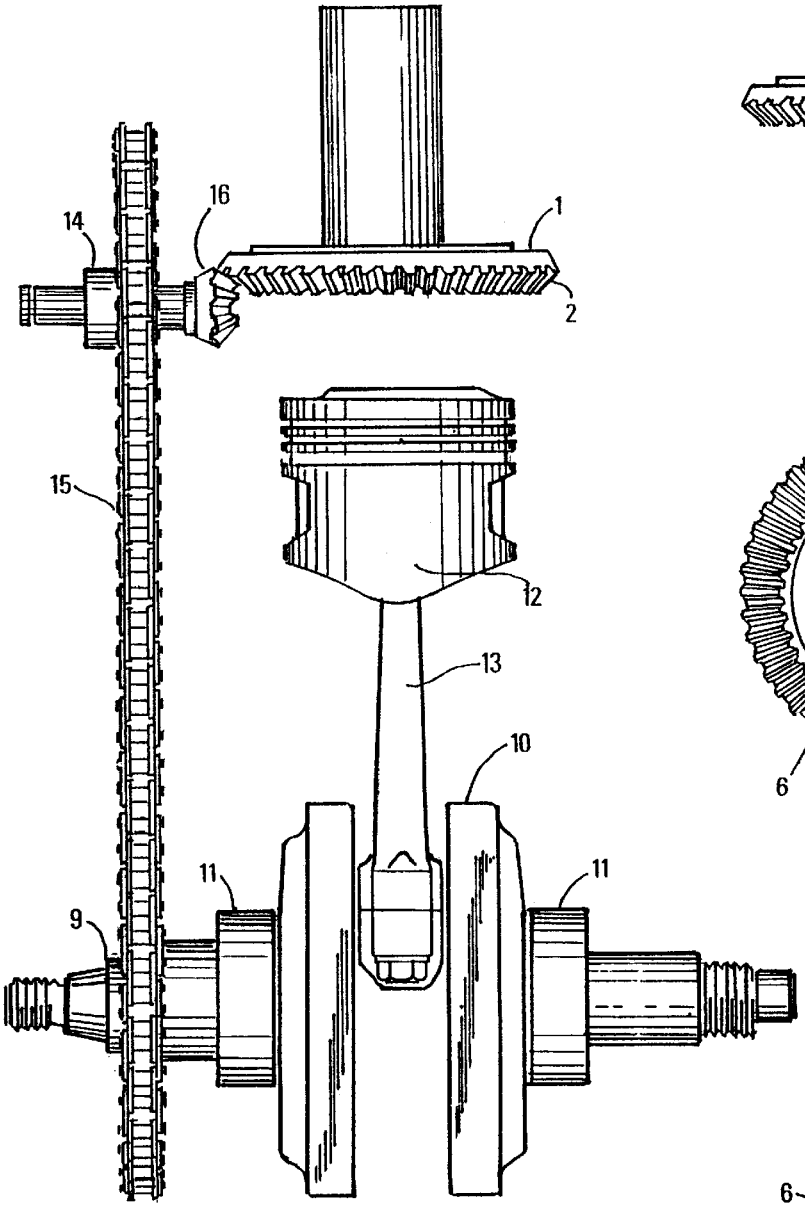
FIG. 4 Shows the elements of the valve-train which produce the means of rotation of the disc valve.

Turning now to FIG. 4 which shows the engine valve-train components that provide the means of rotation of disc 1. Sprocket gear 9 is fixedly attached to crankshaft 10 which is caused to rotate in bearings 11 by engine piston 12 acting through connecting rod 13 in the general manner of four-bar slider mechanism. The rotation of sprocket gear 9 is transmitted to sprocket gear 14 through chain 15. Sprocket gear 14 is fixedly attached to the shaft of bevel pinion gear 16 which is meshed with the bevel teeth 2 of disc 1. The ratio of the pitch diameters of the sprocket gear 9 to sprocket gear 14 is 1 to 1. The gear ratio of pinion 16 to disc 1 gear teeth is 8 to 1. By these gear ratios disc 1 is made to rotate one whole revolution for every 8 revolutions of crankshaft 10.

Figure 5:
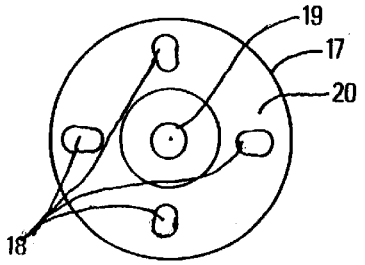
FIG. 5 Is a top view of the indexing stator.

FIG. 5 is a top view of the indexing stator 17 comprising four equally spaced indexing ports 18, spark plug recess 19 and surface 20 which is in slidable contact with surface 5 of disc 1.

Figure 6:
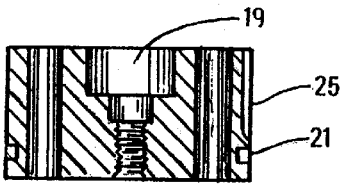
FIG. 6 Is a section taken through the axial center of the indexing stator passing through two opposite indexing ports.

Turning now to FIG. 6 which shows a sectional side-view taken through the axial center of indexing stator 17 and passing through indexing ports 18 and threaded spark plug hole 19. Also shown in FIG. 6 is key slot 25 and groove 21 for mounting a seal.

Figure 7:
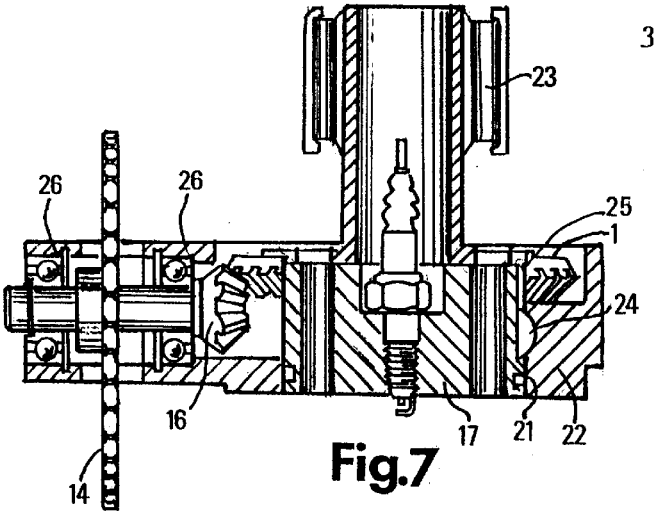
FIG. 7 Is the cylinder head shown principally in cross-section showing the rotative mounting of the disc valve and its pinion gear as well as the installation of the indexing stator and the mounting of the engine spark plug.

Turning now to FIG. 7 showing disc 1 and its associated gearing installed in the engine cylinder head 22. Disc 1 is rotatively mounted in roller bearing 21. Indexing stator 17 is mounted in cylinder head 22 and held in its relative axial position by key 24 in key slot 25 machined in cylinder head 22. Bevel pinion 16 shaft holding sprocket gear 14 is rotatively mounted in cylinder head 22 on bearings 26. Rotation of sprocket 14 causes bevel gear 16 to turn disc 1. The ports 6 of disc 1 open and close the aligned and corresponding indexing ports of stator 17 when disc 1 is rotated.

Figure 8:
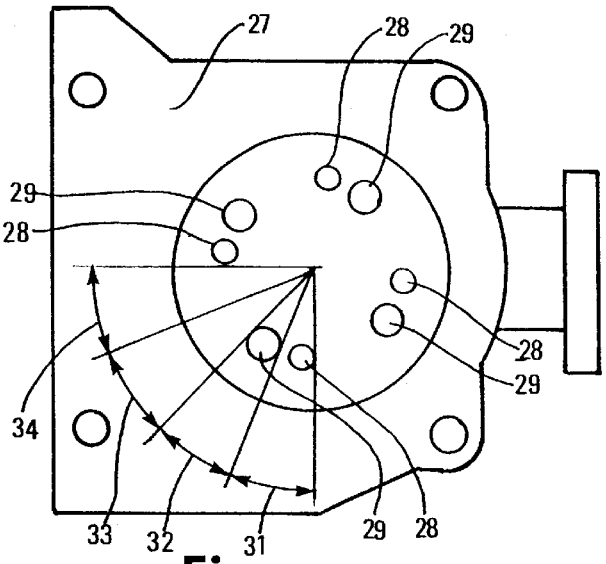
FIG. 8 Is a top view of the engine manifolding.

Turning now to FIG. 8 which shows the bottom surfaces of cylinder head manifolding 27 that holds roller bearing 23 when mounted on cylinder head 22 of FIG. 7. Cylinder head manifolding 27 has four sets of exhaust and intake ports which correspond to the 4-ports of disc 1 such that the rotation of disc 1 sequentially opens and closes each set of exhaust and intake ports in a synergistic manner with rotation of engine crankshaft 10 of FIG. 4. The exhaust ports 28 and intake ports 29 occupy the first two equally spaced 22.5 degree segments 31 and 32 respectively of each quadrant of disc 1 circumference. The remaining two 22.5 degree segments 33 and 34 of the quadrant comprise the corresponding compression and power stroke portions respectively of the 4-stroke engine cycle. Those skilled in the art will readily recognize that as in the case of all engine valve timing, such as early exhaust opening and cyclic overlap may require slight adjustment of the individual placement of exhaust ports 28 and intake ports 29.

Figure 9:
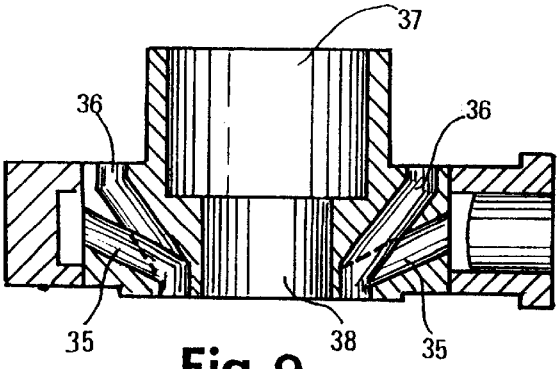
FIG. 9 Is a longitudinal section taken through center of the engine cylinder manifold and for clarity of description assumes that the cutting line also passes through two sets of exhaust and intake ports and associated conduits.

FIG. 9 is a pictorial section taken through the axial center of the cylinder head manifold 27 of FIG. 9 and shown by graphical license to pass simultaneously through corresponding oppositely opposed exhaust ports 28 and intake ports 29. Exhaust conduits 35 carry exhaust gases from exhaust ports 28 into exhaust manifold 30. Intake conduits 36 carry the air/fuel charge to intake ports 29. Also shown in FIG. 9 is roller bearing 23, housing 37 and spark plug hole 38.

Figure 10:
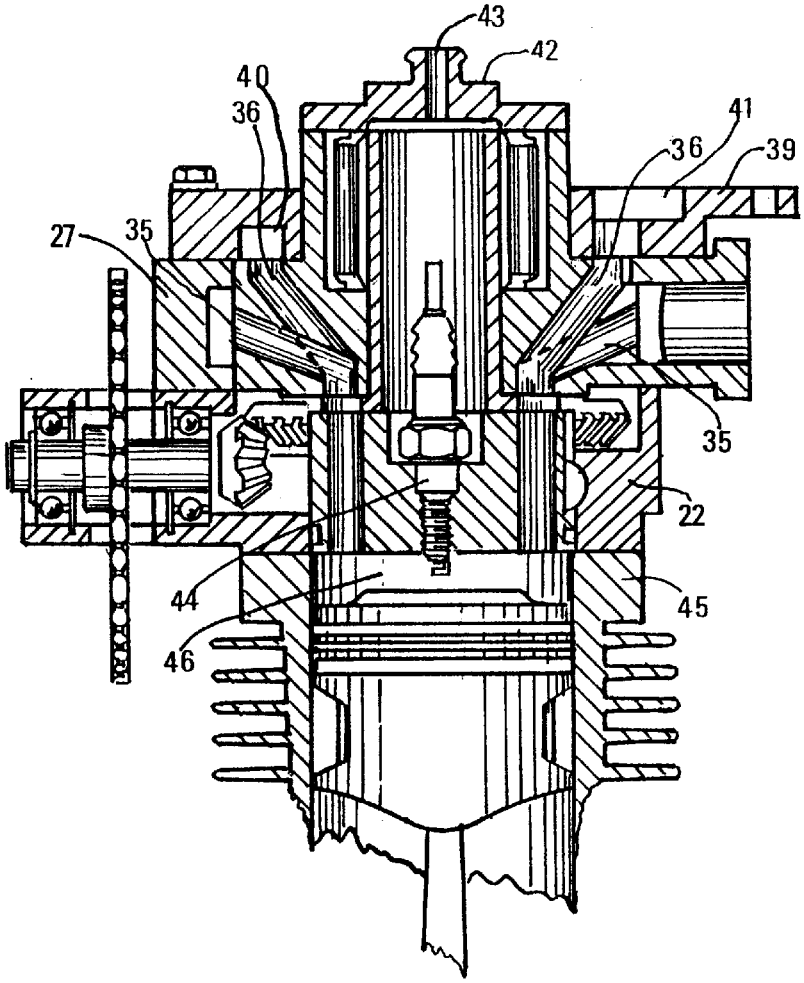
FIG. 10 Shows the engine cylinder head assembly shown principally in cross-section.

Turning now to FIG. 10 which shows the cylinder head assembly principally in cross-section. Intake manifold 39 is fixedly mounted on the cylinder head manifold 27. The intake manifold 39 is comprised of circular gathering conduit 40 and carburetor mount 41 and cap 42 having an opening 43 for the passage of a high tension cable to spark plug 44. Beneath intake manifold 39 is the cylinder head manifold 27 fixedly mounted on cylinder head 22. Disc 1 is rotatively mounted in the said cylinder head manifolding 27 holding roller bearings 23. Bevel pinion 16 is rotatively mounted in bearings 26 mounted in engine cylinder head 22. Rotation of disc 1 by bevel gear 16 being driven by pinion 14 rotated by engine crankshaft 10 sequentially opens and closes exhaust ports 28 and intake ports 29 synergistically in accordance with the relative position of piston 12 slidably mounted in engine cylinder 45 below combustion chamber 46.

Figure 11:
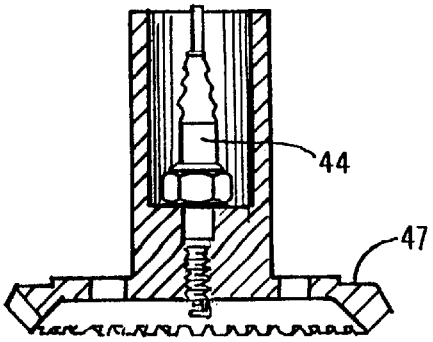
FIG. 11 Shows an alternate installation of the engine spark plug in the disc valve.
Figure 12:
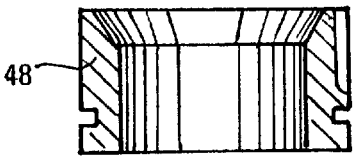
FIG. 12 Shows an alternate method of constructing the indexing stator when the spark plug is installed in the engine disc valve.

A modification of cylinder head 22 shown in FIGS. 7 and 10 which permits longer stroke piston 12 operation and larger clearance volume in combustion chamber 46 without necessitating a corresponding change in the engine height between the intermediate axial centers of rotation between bevel gear 16 shaft and crankshaft 10 is presented in FIG. 11. This is accomplished by mounting spark plug 44 inside of disc 1 and permitting it to rotate with the disc 1 now designated as disc 47. In this instance the high tension wire is in slidable contact with spark plug 44. The center portions of stator 17 comprising indexing ports 18 and spark plug hole 19 are removed leaving only the outer rim components now designated as hollow stator 48.

What is claimed is:

1. A disc rotatively mounted within the cylinder head of a piston driven internal combustion engine operating on the four-stroke thermodynamic principle, said disc having gear teeth upon its outer perimeter such that it is made to turn at one eighth of a revolution for one complete revolution of the crankshaft of said engine, said disc having four ports placed at equal radius from its center and spaced apart at ninety degree intervals about its surface, an indexing stator slidably mounted in said cylinder head, and in slidable contact with said disc, said indexing stator having four ports spaced at ninety degree intervals and being placed at a radius from the center of said indexing stator such that they are brought into periodic alignment with the said ports of said disc at cyclic intervals occurring at each quarter turn of said disc, said disc in slidable contact at its upper surface with a cylinder head manifold, said cylinder head manifold having four sets of exhaust and intake ports being radially spaced at ninety degree intervals about the center of said cylinder head manifold, each said set of exhaust and intake ports occupying a radial section of twenty two and one half degrees at a radial distance from the said center of the cylinder head manifold equal to the said radial distances of said ports of said disc and said ports of said indexing stator such that the combustion chamber of said engine is brought into periodic communication with each said set of exhaust and intake ports individually opening and closing each said exhaust port and each said intake port of each said set in alternate rotation synergistically with the prescribed said four-stroke thermodynamic principle of operation of said engine.

* * * * *